United States Patent [19]

Sher et al.

[11] 4,343,881

[45] Aug. 10, 1982

[54] MULTILAYER PHOTOCONDUCTIVE ASSEMBLY WITH INTERMEDIATE HETEROJUNCTION

[75] Inventors: Arden Sher, Belmont; John B. Mooney, Saratoga, both of Calif.

[73] Assignee: Savin Corporation, Valhalla, N.Y.

[21] Appl. No.: 281,223

[22] Filed: Jul. 6, 1981

[51] Int. Cl.[3] ..... G03G 5/082

[52] U.S. Cl. ..... 430/57; 430/60

[58] Field of Search ..... 430/57, 60

[56] References Cited

U.S. PATENT DOCUMENTS

| | | | |
|---|---|---|---|
| 2,901,349 | 8/1959 | Schaffert et al. | 430/57 |
| 3,635,705 | 1/1972 | Ciuffini | 430/57 |
| 3,639,120 | 2/1972 | Snelling | 430/57 |
| 3,676,210 | 7/1972 | Shattuck et al. | 430/127 |
| 3,679,405 | 7/1972 | Makino et al. | 430/57 |
| 3,725,058 | 4/1973 | Hayashi et al. | 430/58 |
| 3,884,787 | 5/1975 | Kuehnle | 118/718 X |
| 4,150,987 | 4/1979 | Anderson et al. | 430/58 |
| 4,225,222 | 9/1980 | Kempter | 430/57 X |

*Primary Examiner*—James R. Hoffman

*Attorney, Agent, or Firm*—Shenier & O'Connor

[57] ABSTRACT

A multilayer photoconductive assembly with an intermediate heterojunction. The assembly comprises a conductive substrate, a thin semiconductive layer formed of a material of one carrier polarity, which material has a narrow band gap. This layer is in substantially ohmic (low-resistive) contact with the conductive substrate. A light-absorbing layer is formed of a semiconductor which is thicker than the first layer and is of a carrier polarity opposite to the polarity of the first layer. The material has a band gap wider than the band gap of the first layer. The first and second semiconductive layers form a rectifying heterojunction therebetween. This enables the assembly to have a tremendously increased dark resistance and produces an assembly enabling high-speed electrophotography.

14 Claims, 4 Drawing Figures

FIG. 3
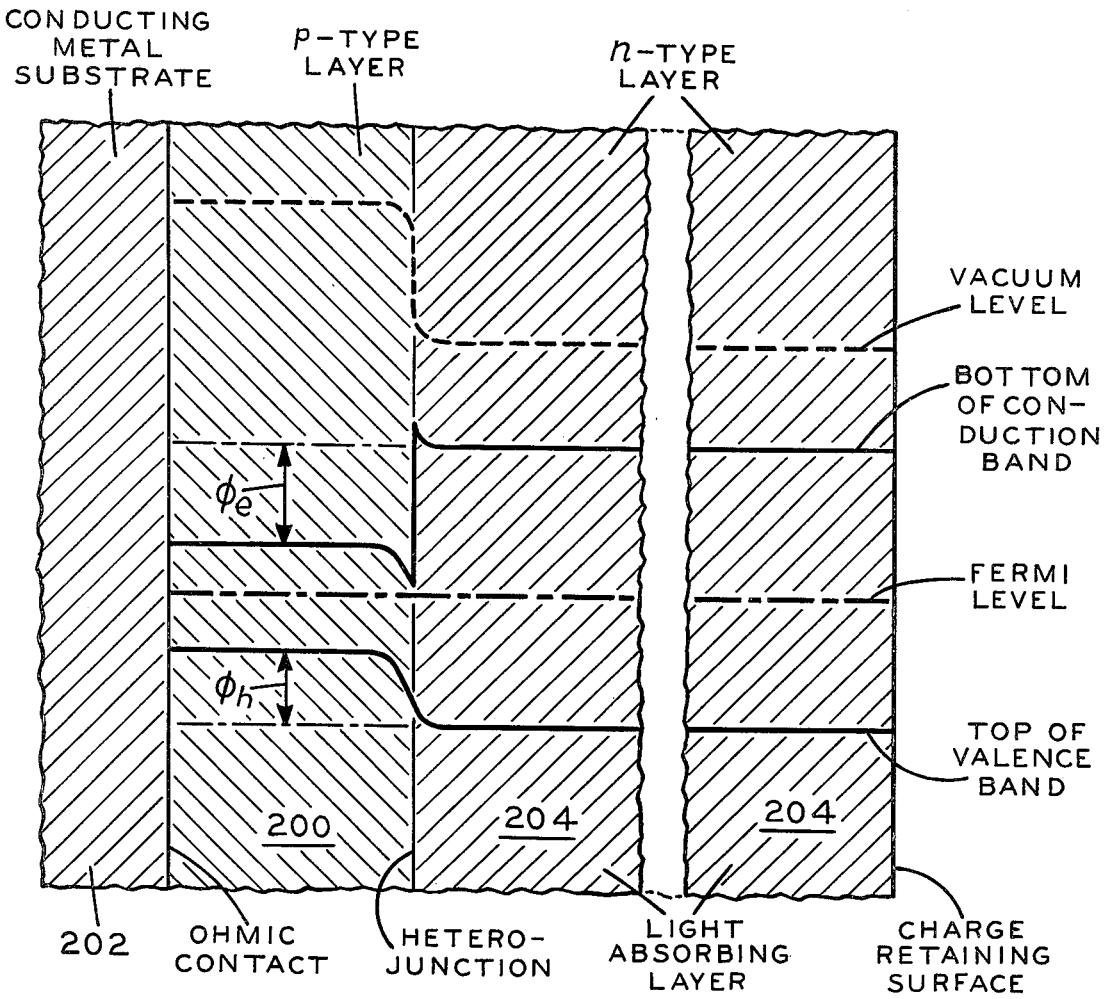
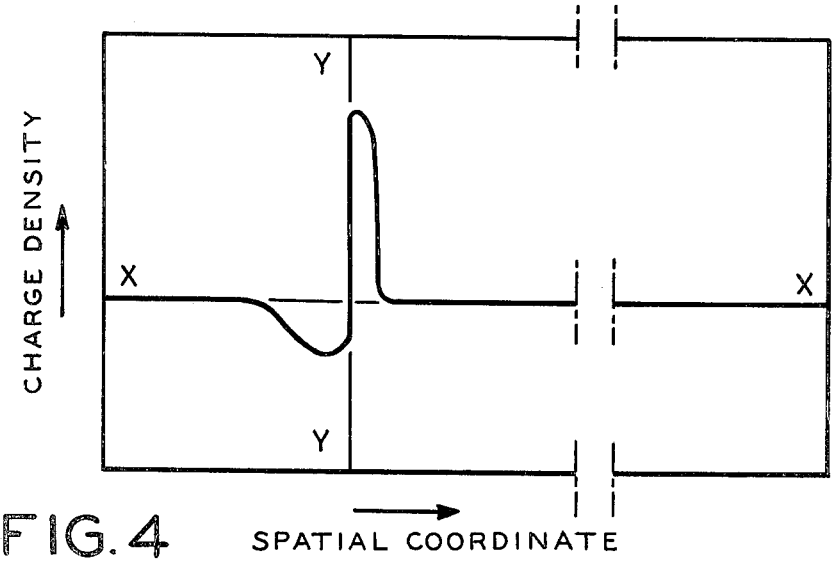
FIG. 4

MULTILAYER PHOTOCONDUCTIVE ASSEMBLY WITH INTERMEDIATE HETEROJUNCTION

CROSS-REFERENCE TO RELATED APPLICATION

This application is an improvement over the copending application of John B. Mooney and Ivor Brodie, Ser. No. 236,739, filed Feb. 23, 1981, relating to a photoconductor comprising a homogeneous alloy of metal sulphides, including a major amount of cadmium sulphide and a minor amount of zinc sulphide.

BACKGROUND OF THE INVENTION

In conventional electrophotography, a photoconductive surface is charged in the dark and then subjected to a light image of an original which is to be reproduced. This generates a latent electrostatic image corresponding to the original, which may be a document or a photograph. The latent electrostatic image is made visible by toning with charged pigment or pigmented particles. The most widely used photoconductor in electrophotographic machines is amorphous selenium which has been corona-charged so that the latent image is formed with positive ions. The toner particles for selenium photoconductors must bear a negative charge, and images may be toned by dry particles which adhere to the latent image and are then fused after transfer to a carrier medium. The toner particles may be disseminated through an insulating carrier liquid so that the toner particles will travel to the latent image by electrophoresis. In the copending application of Mooney et al, referred to above, it is pointed out that selenium has many disadvantages, such as its limited spectral sensitivity range and its poor wear characteristics.

The prior art has recognized the advantages of polycrystalline cadium sulphide as a photoconductor. Unfortunately, the prior art (Kuehnle U.S. Pat. No. 3,884,787) has been unable to form a photoconductor of cadmium sulphide of adequate thickness to create a sufficiently high voltage on the surface of the photoconductor with the required charge densities. As a result, the development of a latent image produced on the surface of the photoconductor will require an inordinately long time period for its development to enable it to be practical. Cadmium sulphide, as an electrophotographic conductor, has several disadvantages. First, it has a memory; that is, after forming a latent electrostatic image, developing that image, and transferring it to a carrier sheet, a portion of the latent electrostatic image remains on the photoconductor. Stated otherwise, the decay time in the presence of light is too slight, so that offsetting occurs. Another disadvantage of cadmium sulphide as an electrophotographic conductor is fatigue; that is, as the photoconductor is used and reused, the maximum voltage to which it can be charged becomes less and less. Cadmium sulphide, however, can retain a much higher charge density than tellurium-doped selenium. Chiefly, cadmium sulphide, in addition to being harder, has a wider spectral photosensitivity than selenium. The photoconductors of the prior art are deficient in that their dark decay is too high. Many advantageous photoconductors cannot be used, owing to their rapid dark decay.

Although our multilayer electrophotographic receptor is described in terms of a conventional electrophotographic process, it is also useful in other modes, such as charge-transfer electrophotography (Walkup, U.S. Pat. No. 2,825,814).

FIELD OF THE INVENTION

Our invention relates to an improved multilayer photoconductive assembly with an intermediate heterojunction to give the assembly a high dark resistance.

DESCRIPTION OF THE PRIOR ART

Schaffert et al U.S. Pat. No. 2,901,349 discloses a multilayer xerographic plate in which the selenium photoreceptor is covered with a transparent insulating coating, such as a vinyl resin, a cellulose ester, a silicone resin, or the like, in order to protect the relatively soft vitreous selenium photoreceptor from abrasion or mechanical damage. This patent also discloses an intermediate layer comprising another photoconductor, such as anthracene, sulphur, and various alloys of selenium. The preferred compound in contact with the conductive layer is arsenic trisulphide, which has a band cap of 2.5 eV. Schaffert et al disclose no rectifying junction in general and no heterojunction in particular. The only way the photo-excited charges reach the conductive substrate is through tunneling or excitation over the barrier.

Dessauer et al U.S. Pat. No. 2,901,348 discloses a p-type photoconductor, such as amorphous selenium. The selenium layer is covered with an outer barrier layer designed to accept a charge of electrons or holes, preventing the penetration of charges through the selenium layer. The selenium layer rests upon a polystyrene sheet, about one micron thick, which serves as a barrier in the dark to prevent charge dissipation, while it has no measurable effect on photo-induced charge dissipation. It is fundamentally a very thin insulating layer (20 to 100 Å thick). This insulating layer may be formed by the treatment of the metallic base to create oxides or sulphides thereon. The metal oxides of the conductive substrate will have a band gap larger than that of the photoconductive material, such as cadmium, silicon, cadmium sulphides, selenium, or organic poly-N-vinyl carbazole and its derivatives. Accordingly, the only way photo-excited charges reach the metallic base is through tunneling or thermal excitation over the barrier. If the insulator is too thick, it will not permit discharge, causing memory and fatigue. If it is too thin, it will leak, causing white areas in the images. Thus, the thickness of the insulator must be held to within close tolerances. This thickness control becomes progressively more critical as the copier speed is increased.

Hill et al U.S. Pat. No. 3,148,084 describes one technique for obtaining photoconductive layers without the use of binders. The prior art, discussed in Hill et al, points out the disadvantages of the evaporation process, the chemical deposition process, and the vapor-reaction process. Hill et al teach the formation of photoconductive films by spraying reagents on a heated substrate, which is the method we use in forming our layers. The photoconductive films taught in Hill et al include sulphides of many metals, as well as sulphoselenides of cadium, cobalt, and indium. The photoconductive films of Hill et al were formed on an insulating substrate. Co-inventor Chamberlin further described the method in the *Journal of the Electrochemical Society,* Volume 113, pages 86–89, in an article written was J. S. Skarman in 1966. The films were not intended to be used for electrophotography, but, rather, in the manufacture of thin-film solar cells. These photovoltaic converters were formed by a thin film of copper sulphide (0.1μ) together with a thin film of cadmium sulphide (1μ).

Murphy U.S. Pat. No. 3,352,669 addresses the problem of charge leakage in the dark (dark discharge) while not preventing the charge dissipation in the presence of light. As in Dessauer et al, the barrier layer of Murphy is created by subjecting the conductive substrate to chemical treatment, specifically to the action of an aqueous mineral acid solution containing chromic acid anhydride ($CrO_3$) or chromic acid ($H_2CrO_4$) in a predominating amount. This creates a thin layer of about a half micron on the metal which carries the photoconductor. Here, as in Dessauer et al, the barrier is a thin insulating layer. The only way to dispose of the photoexcited charge is by thermal excitation over the barrier. No rectifying junction nor a rectifying heterojunction is disclosed.

Corrsin U.S. Pat. No. 3,151,982 attempted to overcome the short life of vitreous selenium photoconductors by using cadmium sulphide particles in a glass binder.

Lane U.S. Pat. No. 3,510,298 also discloses a cadmium sulphide photoconductor in a glass binder. We have found that glassbound cadmium sulphide does not produce a commercially usable electrophotographic photoconductor. The latent electrostatic images, when developed, were full of spots which spoiled the images.

Another method of forming thin-film photoconductors is by sputtering. This process is described by Kuehnle in U.S. Pat. No. 3,884,787. Films having a thickness up to 0.5μ (5,000 Å) were formed. These films were transparent to yellow light and were excellent photoconductors.

The cadmium sulphide formed by spray pyrolysis under one set of conditions, disclosed by Hill et al U.S. Pat. No. 3,148,084, produces a "brown" cadmium sulphide which is sufficiently disordered so that it behaves like an amorphous material. The properties of amorphous materials are just beginning to be understood, and this area has currently attracted much research. Neville F. Mott and Philip W. Anderson received their Nobel prizes in 1977 for their work in this area. Cadmium sulphide, under high-temperature conditions, is yellow and has completely different properties. Our recognition that "brown" cadmium sulphide is a disordered material, along with an understanding of the mechanism causing this behavior, constitutes an important advance in the art.

Ciuffini U.S. Pat. No. 3,635,705 points out the salient deficiency of single-layer halogen-doped selenium and halogen-doped arsenic-selenium alloys and, more particularly, their relatively high dark decay rates. Ciuffini's assembly comprises an outer layer of vitreous selenium with an intermediate layer of halogenated vitreous selenium. There is no disclosure of a rectifying junction of any sort. Selenium is a p-type material. The maximum doping with halogen is pointed out in Column 3, beginning at line 51, to be ten parts per million, with a lower limit of twenty parts per million. One percent of halogen will not form an alloy nor convert the p-type material into an n-type material. It is interesting to note that, in EXAMPLE I (Column 5, beginning at line 56), Ciuffini used an oxidized aluminum drum with an arsenic-selenium photoreceptor doped with 66 p.p.m. chlorine. This drum, in EXAMPLE II, was overcoated with a five-micron layer of undoped selenium. It is clear that the reason Ciuffini obtained an improved reduction in the dark discharge was because he inadvertently used an oxidized aluminum drum. The oxidized layer acted as a barrier, similar to the barriers taught by Dessauer et al, Schaffert et al, and Murphy.

Snelling U.S. Pat. No. 3,639,120 is similar to Ciuffini, except that the light-receptive layer is comprised of a more sensitive photoconductive material, such as selenium-arsenic or selenium-tellurium alloys. The halogen doping of the intermediate layer is one percent or less, which is insufficient to convert the host material, which is p-type, to an n-type material and hence form a p-n junction.

Shattuck et al U.S. Pat. No. 3,676,210 discloses a recognition of the defects in Hill et al U.S. Pat. No. 3,148,084, for use as an electrophotographic photoconductor, and attempts to overcome these disadvantages of a thin film by using a resin binder. In Shattuck et al, the inventors use an aqueous emulsion of polyvinyl acetate in the method disclosed by Hill et al and obtain a resin-bound cadmium sulphide photoconductor. There is no disclosure of the use of zinc or of copper as dopants. Reference is made, in Shattuck et al, to Middleton et al U.S. Pat. Nos. 3,121,006 and 3,121,007, both of which disclose a photosensitive layer consisting of an inorganic photoconductive powder dispersed in a resin binder. Shattuck et al merely use the Hill et al process to manufacture the Middleton et al products. Shattuck et al set forth that the photoconductive compounds which are formed by their method are not crystalline, but are, instead, amorphous.

Makino et al U.S. Pat. No. 3,679,405 discloses a multilayer photoconductive assembly comprising a photoconductive powder containing mostly cadmium sulphide and cadmium carbonate with adsorbed cadmium iodide which can be sensitized to various sensitivities by dye sensitization. There are no layers of amorphous material formed without the use of any binders. No rectifying junctions are formed.

Andersons et al U.S. Pat. No. 4,150,987 discloses a charge transport layer comprising hydrazones and a photoconductive layer which is formed of "inorganic charge generating materials", including selenium and tellurium. This dual layer is positioned on a conducting layer (not shown). The figures show that the selenium layer 12 of Anderson et al retains a positive charge even when, as shown in FIGS. 1 and 2, it is in contact with an electrically conductive layer. In order for Anderson et al to operate as the inventors describe, there must be a barrier layer between the electrically conductive layer and either the selenium layer 12 (FIGS. 1 and 2) or the hydrazone layer 14 (FIGS. 3 and 4). As is known in the art, whenever a photoconductor is placed on a conductive layer, a Schottky barrier is created. The presence of a barrier explains the positive charges between the layer 12 and the electrically conductive substrate or the negative charges between the layer 14 and the electrically conductive substrate. In FIGS. 1 and 2, the layer 14 is charged with a negative corona; in FIGS. 3 and 4, the selenium or tellurium layer 12 is positively charged. In our invention, there must be an ohmic contact between the metal substrate and a semiconductor having a narrow band gap, so that the heterojunction will act as a rectifying one and prevent the injection of charges into the photoconductor. This enables the heterojunction to perform its function of blocking the dissipation of charges in the dark state—that is, to increase its dark resistance.

Hayashi et al U.S. Pat. No. 3,725,058 shows a selenium layer sandwiched between a layer of poly-N-vinyl carbazole and its derivatives. The selenium is formed on an aluminum substrate 1 by evaporation in a vacuum, while the organic layer is applied by a conventional knife method and dried at 50° C. FIG. 1 of Hayashi et al is similar to Anderson et al, in that there is no teaching of an ohmic contact between the selenium layer 2 and the aluminum layer 1. As a matter of fact, FIG. 2 of Hayashi et al specifically shows a barrier layer 4 comprising a film of cellulose acetate, polystyrene, polyethylene, or the like. There is no disclosure of an ohmic contact between the metal conducting substrate and a semiconductor having a narrow band gap which forms the heterojunction with another photoconductive material having a wider band gap.

Kempter U.S. Pat. No. 4,225,222 discloses a photoconductor comprising a homogeneous junction formed of two layers of amorphous silicon. One layer is doped negative, and the other layer is doped positive to form a p-n homojunction. There is no disclosure of the substrate material of which the printing drum of Kempter is made. However, since the surface 21 of the printing drum must act as one electrode connected to the high-frequency generator of the gaseous silicon deposition process of Kempter, it must be of conductive metal. There is no disclosure, however, that there is an ohmic contact between the silicon deposited on the printing drum and the metal substrate.

Silicon crystallizes in a lattice structure in which each atom is surrounded by four other atoms. The four outer valence electrons in silicon then contribute one electron each to bond with its four neighbors. Each bond is normally occupied by two electrons. Because it is possible for electrons to hop from one bond to an adjacent one, the energy states corresponding to the bonding states are spread in the solid into a band. This band is the valence band, and it is totally occupied in a perfect solid. The two electron orbitals from adjacent atoms not only form a bonding state, but also an antibonding state. The antibonding state also spreads in the solid and becomes the conduction band. In a perfect solid at low temperature, the conduction band is empty. There is an energy gap that separates the highest energy of the valence band from the lowest energy of the conduction band. This energy gap is referred to as the "band gap".

If one substitutes an impurity atom which has five electrons—for example, phosphorus—into the otherwise perfect silicon lattice, then four of these electrons contribute to the four bonds with the surrounding silicon atoms and the fifth electron is weakly bonded. This fifth electron is easy to excite into the conduction band. Impurities that tend to give up electrons to the conduction band are called donors. On the other hand, impurities which, if substituted for a silicon atom, tend to take an electron from the valence band are called acceptors. Aluminum, which has only three electrons in its valence shell, is an example of an acceptor in silicon.

In Kempter, diborane is used to dope the silicon with boron to make p-type, and phosphine is used to dope the silicon with phosphorus to make n-type. The gaseous dopants are supplied with gaseous silane ($SiH_4$) which forms the amorphous silicon on the substrate.

If the valence band is filled, it cannot contribute to the conductivity of the sample. In that case, every bond is occupied so there is no net transport of electrons from one region of the sample to another. Also, if there are no electrons in the conduction band, those states will not contribute to the conductivity. When acceptors are present that have extracted electrons from the valence band, then there are unoccupied valence band states. In this case, electrons from adjacent bonds can move into the unoccupied states and, as a consequence, it is possible for them to transport across the material. It is conventional to think about these unoccupied states as the particles that are actually moving. In this case, these unoccupied states are referred to as holes. The holes behave as though they are positively charged, and in an electric field transport in the opposite direction to the direction the electrons move. Obviously, when donors are present that have contributed electrons to the conduction band (are ionized), the conduction band electrons can move. A sample with more ionized donors than acceptors is called n-type, and one with more acceptors than donors is called p-type.

The Fermi energy is a useful concept that summarizes the populations of occupied states and the way energy states from two dissimilar materials align at a junction. The Fermi energy is that energy at which, if a state existed there, it would have a probability of one-half of being occupied. In semiconductors, the Fermi energy most often lies somewhere in the band gap where no states actually exist. In an intrinsic material (no net donors or acceptors ionized), the Fermi energy is near mid-gap. In n-type material, the Fermi energy is in the upper half of the gap, and in p-type, the Fermi energy lies in the lower half of the gap. When the Fermi energy lies above the conduction band edge, the material is said to be degenerate n-type, and if it lies below the top of the valence band, then the material is said to be degenerate p-type. In degenerate material, the conductivity is high, approaching that of metal.

One can also show that the Fermi energy is the Gibbs free-energy per particle for the electronic system. As is known to those skilled in the art, the Gibbs free-energy is a measure of thermodynamic potential. The Gibbs free-energy per particle for two systems that are in thermodynamic equilibrium at constant pressure and temperature must be the same. It is this property that makes the Fermi energy so useful in understanding the behavior of homojunctions and heterojunctions. In thermal equilibrium, a space charge distribution on both sides of the junction forms, such that the Fermi energies of the two materials align.

Cadmium sulphide is a II-VI compound, but it still has a significant amount of covalent bonding of the type described for silicon. Each cadmium atom is surrounded by four sulphur atoms and vice versa. If a Column I element is substituted for a cadmium element (e.g., a copper atom), it acts like an acceptor. If a Column III element is substituted for cadmium, it is a donor. Similarly, Column V elements replacing sulphur are acceptors, and Column VII elements are donors (e.g., chlorine). A sulphur vacancy acts like a donor, and a cadmium vacancy behaves like an acceptor. Many other defects are active, behaving like traps, recombination centers, donors, or acceptors.

SUMMARY OF THE INVENTION

Our invention contemplates a multilayer photoconductive assembly comprising a light-absorbing layer formed of a photoconductive material of one type having a wide band gap forming a heterojunction with a photoconductive layer of an opposite type having a narrower band gap, which layer is in ohmic contact with a conductive substrate. The light-absorbing layer may be either n-type or p-type. The intermediate layer is preferably of opposite type; that is, if the light-absorbing layer is of n-type, then the intermediate layer is of p-type. It is important that the intermediate layer make substantially ohmic contact with the conductive substrate and have a narrower band gap than the light-absorbing layer. The narrow band gap is achieved in the CdS-based system by formulating the appropriate $Cd_{1-x}Pb_xS$ alloy as the contact layer. The light-absorbing layer is a nearly intrinsic semiconductor with the Fermi energy located about midway between the conduction band edge and the valence band edge. This situation is characteristic of disordered semiconductors. Since the Fermi level is near midgap, the distinction between n-type and p-type material in the photoconducting layer is not too important. The sign of the corona charge for a given photoconductor is chosen so the most mobile species is the one that must traverse the photoconducting layer to form the image. For example, CdS, which has a higher electron than hole mobility, is usually run with a negative corona. Most electron-hole pairs are generated by the light near the front surface. The holes need only travel a short distance to neutralize the negative charge on the front surface, while the more mobile electrons travel through the whole thickness of the photoconductor to reach the heterojunction. The contact layer is preferably a high carrier concentration semiconductor of an opposite type to the sign of the corona charge. If the band gap of the contact layer is narrow enough, this arrangement produces a heterojunction which is doubly rectifying; that is to say, both signs of charge may pass in one direction but not in the other. This differentiates the preferred type of heterojunction from a homojunction or a blocking junction. The heterojunction produces a blocking potential which prevents holes from being injected from the contact layer into the light-absorbing layer, while permitting electrons in the light-absorbing layer easily to transport into the conduction band of the contact layer. Similarly, holes in the light-absorbing layer can easily transport into the conduction band of the contact layer, but holes cannot pass from the contact layer to the conduction layer. The band gap of the contact layer should not be so small that band-to-band tunneling becomes a problem. The lattice constants of the photoconductive material of the light-absorbing layer should preferably be matched to the contact layer. If the lattice constants of the two materials are the same, there will be less stress at the heterojunction and there will be fewer interface states to act as scattering centers and reservoirs of fixed charge. Our arrangement is such that it allows charge to flow from the light-absorbing photoconductor to the grounded metal substrate, but blocks charge from being injected into the photoconductor from the metal substrate. Our arrangement, furthermore, increases the charge density that can be placed on the front surface of the photoreceptor while decreasing the fatigue, memory, and residual voltage. Stated otherwise, there is increased resistance to leakage of the charge in the dark while increasing the conduction of charge in the light. In the electrophotographic process, the light-absorbing layer is first charged by a corona and then exposed to a light image of an original, which may be a document or a photograph, to generate a latent electrostatic image. This image is developed with a toner. The density of the toned image is limited by the charge density of the latent image, and the development speed is a function of the surface field which attracts the toner particles. Accordingly, both a large surface charge and a low capacitance (thick) photoreceptive layer are desirable. The maximum useful thickness is limited by the time for the charge to transport through the receptor layer, the trapping effects that produce unwanted bulk space charge, and the desired resolution.

OBJECTS OF THE INVENTION

One object of our invention is to produce a multilayer photoconductive assembly with an intermediate heterojunction which is rectifying.

Another object of our invention is to produce a disordered cadmium sulphide photoconductive assembly in which the Fermi energy is pinned slightly above midgap so that the material is n-type but nearly intrinsic.

Still another object of our invention is to provide a cadmium sulphide photoconductive assembly in which the spectral response is extended toward red.

A further object of our invention is to provide a disordered cadmium sulphide photoconductive assembly having mobility and trap edges in the conduction and valence bands.

A still further object of our invention is to provide a disordered cadmium sulphide photoconductive assembly in which the carrier concentration is nearly independent of doping levels.

An additional object of our invention is to provide a heterojunction layer interposed between an n-type photoreceptor and a metal substrate comprising a cadmium-lead-sulphide alloy doped p-type.

Other and further objects of our invention will appear from the following description.

BRIEF DESCRIPTION OF THE DRAWINGS

In the accompanying drawings, which form part of the instant specification and which are to be read in conjunction therewith, and in which like reference numerals are used to indicate like parts in the various views:

FIG. 3 is a view, similar to FIG. 1, with an energy band diagram superimposed upon a generic disclosure of our multilayer photoconductive assembly with an intermediate heterojunction.

FIG. 4 is a diagram showing the charge distribution producing the potential step necessary to link the Fermi energies of the p-type and n-type photoconductive layers.

DESCRIPTION OF THE PREFERRED EMBODIMENT

Figure 1:
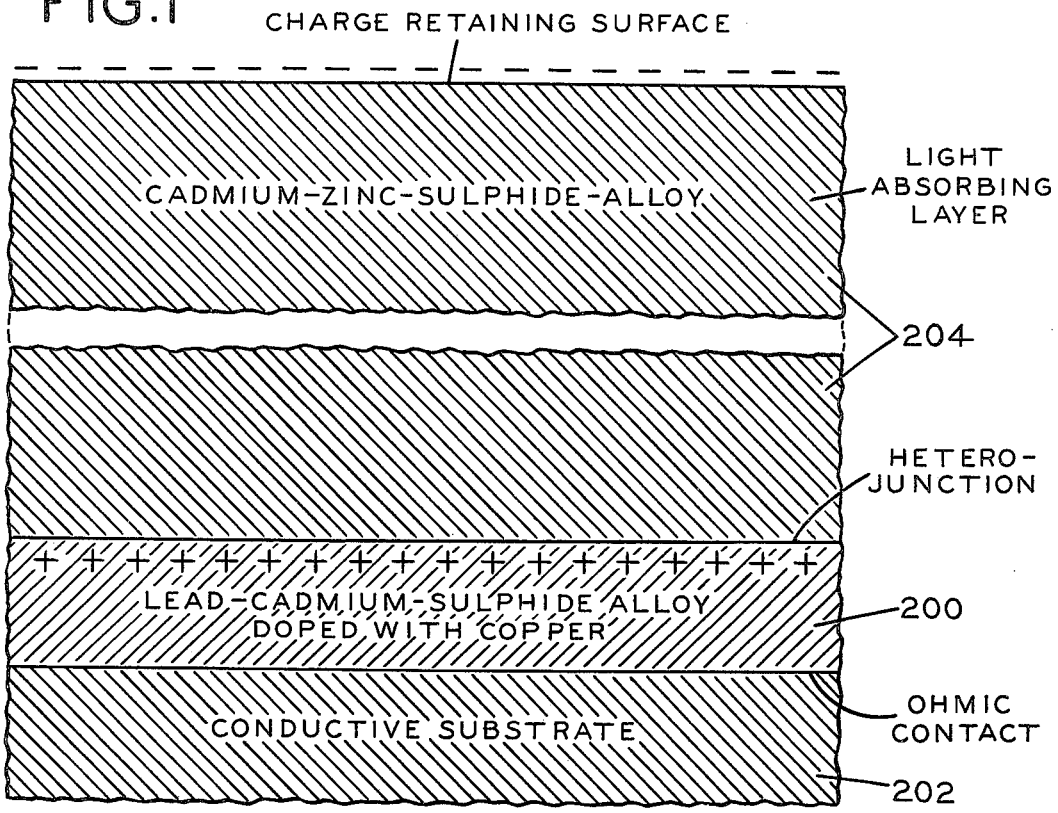
FIG. 1 is a diagrammatic view, drawn on an enlarged scale with parts broken away, of a preferred embodiment, showing a fragment of our improved photoconductive assembly.
Figure 2:
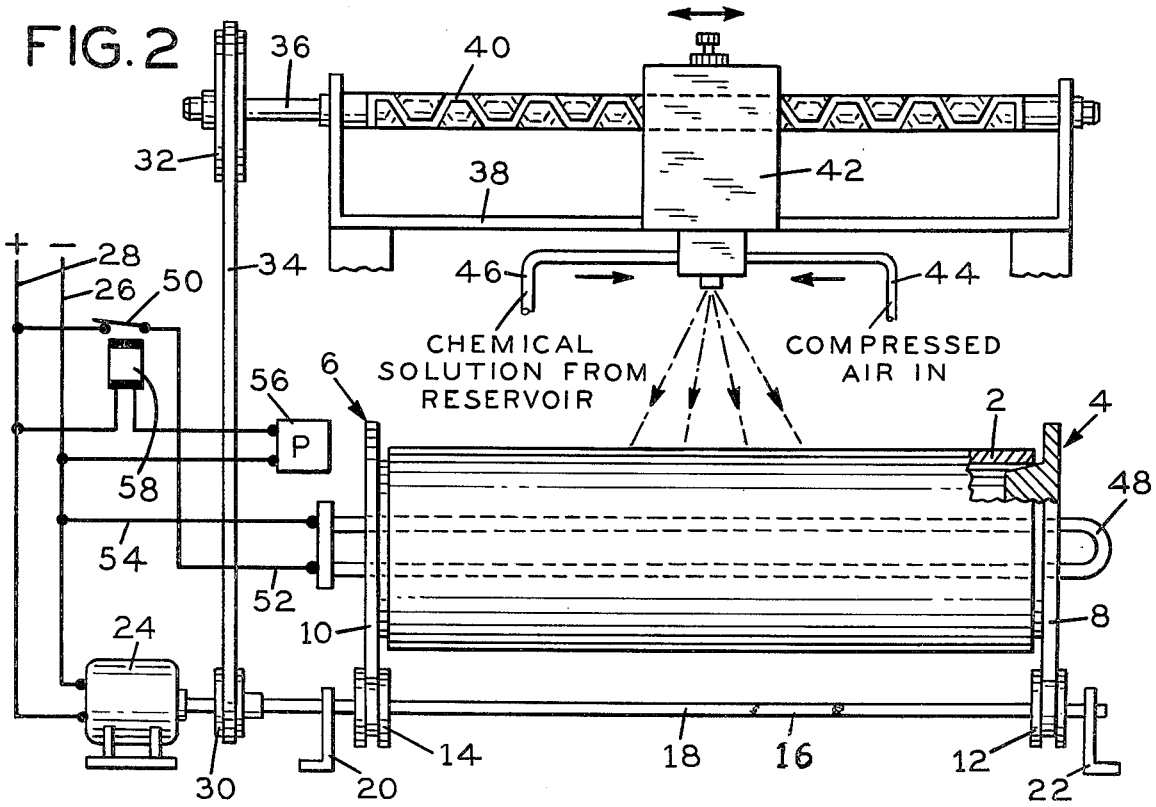
FIG. 2 is a diagrammatic view of apparatus capable of manufacturing the photoconductive assembly shown in FIG. 1.

More particularly, as pointed out in the copending application of John B. Mooney and Ivor Brodie, referred to above, in forming our improved electrophotographic photoconductor, we employ a spray pyrolysis process which is known to the art. The apparatus for forming the photoconductor is shown in FIG. 2, in which a metal drum 2, formed of aluminum or mild steel, is plated with chromium or cadmium. It is thoroughly cleaned before starting the process, first with nitric acid, then with water, and then with household detergent, until no oil or grease is present. The presence of oil on the surface of the drum can be detected by the break test; that is, a drop of water will break into an even film on the surface when it is completely oil-free. After this, the surface is rinsed with deionized water and then with isopropyl alcohol to clean off the water. In the many photoconductors which we made, we employed a chromiumplated drum for corrosion control. We have found that a stronger bond is created with cadmium plating, which permits thicker semiconductor layers to be grown on it before flaking sets in. However, the cadmium layer is distorted by the strains introduced in the growth process, resulting in unacceptable images.

The drum 2 is mounted on a pair of fixtures 4 and 6 into which the drum may be fitted by friction, as can readily be seen by reference to FIG. 2 of the drawings. The fixtures 4 and 6 are provided with flanges 8 and 10 which engage two pairs of rotary saddles 12 and 14, shown in FIG. 2. The saddles are mounted on a pair of shafts 16 (behind 18) and 18 which are carried by two pairs of pedestals 20 and 22. The shaft 18 is driven by a prime mover such as an electric motor 24 supplied with voltage through conductors 26 and 28. The shaft 18 carries a drive pulley 30 which drives a pulley 32 through a belt 34. A shaft 36 is mounted in a fixture 38 for rotation with pulley 32. It carries a double helical screw 40 adapted to reciprocate an atomizing head 42 back and forth along the fixture 38. Attached to the atomizing head 42 we position a pair of flexible hoses 44 and 46. The hose 44 is connected to a source of compressed air (not shown) having a pressure in the order of twenty pounds per square inch. The hose 46 communicates with the aqueous reagent solutions which are used successively to obtain the two differing cadmium sulphide compositions forming our new multilayer photoconductive assembly. The reagent solutions may be fed by gravity or by air pressure, or in any other appropriate manner known to the art. The rate of flow is governed by a valve (not shown) positioned between the reagent-solution supply and the atomizing head 42 and is controlled to form a spray, at the rate of 300 cc. or less per hour, of reagent for contact with the drum 2. A resistance heating element 48 is positioned in the interior of the rotating drum 2. Current flows from the conductor 28, connected to the source of potential, through armature 50 of a relay, through conductor 52, through the heating element 48, through conductor 54 to complete the circuit through conductor 26 to the source of potential. A pyrometer 56 is positioned to sense the temperature on the surface of the drum 2 being coated. It is set to a temperature between 130° C. and 200° C. If the temperature becomes too high, a winding 58 of the relay opens the circuit by lifting armature 50. When the temperature cools to within the desired range, the winding 58 is de-energized and the armature 50 again energizes the heating element 48. The heating element 48 may be a parallel arrangement (not shown) of three elements, only one of which is controlled by the pyrometer 56. By this means, only one third of the power is controlled and the temperature excursions are reduced. It is to be understood that any appropriate pyrometer known to the art, such as a thermocouple, may be employed. The average temperature at the surface of the drum is maintained at about 175° C.

In attempting to produce a cadmium sulphide electrophotographic photoconductor, Mooney and Brodie experimented for about three years and coated on the order of five hundred test drums before determining the best mode of carrying out their invention. They soon learned that most cadmium sulphide photoconductors, while having photoconductive properties, would not be operative in the electrophotographic mode to produce an acceptable electrophotographic image when used in electrophotographic machines. Cadmium sulphide has a natural hardness and, hence, greatly improved abrasion resistance over vitreous selenium. Their improved cadmium sulphide photoconductor was able to produce over a million copies, as compared with not more than one hundred thousand copies for vitreous selenium, when used in a conventional plain-paper photocopying machine. Cadmium sulphide photoconductive films having sufficient thickness could not be formed by spray pyrolysis. If it was attempted to make the film too thick, it would flake from the metal substrate. A thin film would give rise to only a small voltage level. Furthermore, the dark decay was too high, so that it would take several passes under one corona to charge the photoconductor to the maximum level permitted by the thin layer of cadmium sulphide. Attempts to raise the voltage level would cause the cadmium sulphide photoconductor to break down. Moreover, cadmium sulphide had a memory; that is, after imagewise exposure, development, and printing on the carrier sheet, the latent image still remained on the photoconductor. The decay time in the light was too slow. We also found that, after using a cadmium sulphide photoconductor for a while, the maximum voltage to which it could be charged became less and less. We made numerous experiments to improve this situation, each of which led us to the present invention, step by step.

Cadmium sulphide is generally less sensitive to red light. The addition of copper, as is known to the art, sensitizes cadmium sulphide to red light. We found that the addition of copper also reduced fatigue and memory, and the resultant electrophotographic photoconductor was rendered sensitive across the whole spectrum, including the red area.

A good photoconductor for use in electrophotographic machines must be able to accept a voltage sufficiently high, especially when developed by electrophoresis with toner particles suspended in an insulating carrier liquid, so that development will take place rapidly. This is a function of both the thickness of the photoconductor and its dark resistance. We found that the incorporation of zinc, in the form of zinc sulphide, enabled the photoconductor to be charged to a higher voltage and widened the band gap of the cadmium sulphide.

In making photoconductor-coated drums containing no zinc, the charge level was not high enough to make for rapid development. Furthermore, the contrast between the most highly exposed areas and those lesser exposed suffered. The addition of zinc made an enormous difference. The addition of zinc, however, makes the photoconductor less sensitive to red, so that there is a limit, readily determined by the color response, to which zinc can be added.

We have discovered that it is necessary, in our improved multilayer photoconductive assembly, to have low resistance between the contact layer and the conductive substrate in order to avoid flaws in the image and deterioration of the contact layer. Accordingly, before starting the cleaning process pointed out above, we sandblast the metal substrate of the drum with fine-grained sand (320 to 500 mesh). This creates a roughened surface which accomplishes two results: First, the roughened surface increases the contact area, which improves the ohmic contact between the contact layer and the metal substrate; and secondly, it enables the contact layer to adhere more strongly to the substrate.

Ideally, the resistance between the contact layer and the conductive substrate should be zero. In order for our multilayer photoconductive assembly to operate satisfactorily, the resistance between the contact layer and the conductive substrate must be small enough so its response time is faster than the shortest response time in the copier system in which it is used. The critical shortest response is the time the photoconductive drum bearing the photoconductive assembly is under the corona. If the corona is one inch in width and the drum surface speed is sixteen inches per second (typical of a sixty-copy-a-minute machine), this time is 62.5 milliseconds. The capacitance contributing to the ohmic contact response time is limited by the thickness of the contact layer. As we will point out hereinbelow, our contact layer is usually one micron in thickness. This will give a capacitance of $9\times10^{-9}$ farads per square centimeter. From the foregoing, it will be seen that the resistance of the contact area must be less than approximately $7\times10^{6}$ ohms per square centimeter. We measured the resistance of the contact layer of one of our photoconductive drums by means of a "Solartron" (trademark) frequency response analyzer and found the contact layer of a drum made in accordance with the instant invention to be less than $1.7\times10^{6}$ ohms per square centimeter. This indicates that our multilayer photoconductive assembly, operating in a photocopying machine, can produce in excess of 240 copies per minute before this constraint limits the speed.

We form our light-absorbing layer and our contact layer by spray pyrolysis, as described in Hill et al U.S. Pat. No. 3,148,084. As we have pointed out above, in carrying out the spray pyrolysis, the drum 2 is maintained at a temperature of about 175° C. We have found that by making a "hot start"—that is, by heating the drum to a temperature of between 220° C. and 250° C.—when we begin the spray pyrolysis of the contact layer, an improved ohmic contact is obtained. After the process has been started, the pyrolysis is continued at 175° C.

It is known that cadmium sulphide cannot be doped p-type. There is a technical distinction between substances which are called "dopants" in semiconductors and those which constitute the host material. Dopants usually have a different valence from that of the host material and act as donors or acceptors. Our host materials are pseudobinary semiconductor alloys: lead-cadmium-sulphide ($Pb_{1-x}Cd_xS$) for the contact layer and cadmium-zinc-sulphide ($Zn_{1-x}Cd_xS$) for the light-absorbing layer. In zinc-blend structured semiconductors (those with the same structure as zinc sulphide), there are two sublattices: the cation (zinc) sublattice and the anion (sulphur) sublattice. In the alloy $Pb_{1-x}Cd_xS$, for example, the anion sublattice sites have a sulphur atom on each of them, but the cation sites are occupied at random by the atomic fractions x of Cd and $1-x$ of Pb.

It is important to note that the light-absorbing layer—that is, the cadmium-zinc-sulphide alloy layer—must always have a wider band gap than the contact layer. The bank gap is a function of x in the lead-cadmium-sulphide alloy contact layer; that is, the smaller x becomes, the smaller the band gap becomes. However, there is also more of a mismatch between the lattice constants of the photoreceptive layer and the contact layer. A small band gap in respect of the band gap of the photoreceptive layer tends to produce good rectification. A large lattice mismatch causes high density of the interface states which can modify the heterojunction properties in ways that are deleterious. Lead in the contact layer narrows the band gap and replaces cadmium. Zinc widens the band gap and should not be used in the contact layer. While cadmium sulphide cannot be doped p-type, lead sulphide can.

Referring now to FIG. 3, there are several considerations not encountered in the case of a homojunction such as shown in Kempter U.S. Pat. No. 4,225,222. Not only are the band gaps of the two adjacent photoconductive layers different, but each has a different photoemission threshold, which is the energy difference between the valence band edge and the vacuum state. As is known in the art, there are several possible combinations of band gap, doping type, and photo-emission threshold. Our layer 200, which is the lead-cadmium-sulphide alloy layer, is an appropriate p-type semiconductor, while our layer 204, which is the cadmium-zinc-sulphide alloy layer, is an appropriate n-type semiconductor. It will be noted that the carrier concentration in layer 200 is higher than that of the nearly intrinsic cadmium sulphide layer 204. Because of the difference between the photo-emission thresholds, the potential step required to bring the Fermi levels into alignment is larger than that of a homojunction, so there must be more charge in the dipole layer. Since there are almost no free electrons in layer 204, the dipole layer is formed by holes diffusing from the lead sulphide into the cadmium. The resulting charge distribution is one in which there is a layer in the lead sulphide abutting the junction that is completely depleted of holes, so it is negatively charged to a charge density corresponding to the density of the acceptors. The holes move into the cadmium sulphide and form a thin accumulation layer there. The charge density is shown in FIG. 4. This produces band bending with most of the potential drop on the lead sulphide side of the junction and a spike in the conduction band edge on the cadmium sulphide side of the junction. This band bending should not be so large that the conduction band becomes too close to the Fermi level. If this should occur, electrons will be thermally excited from the valence band of the cadmium sulphide layer into the thin layer of the conduction band of the lead sulphide adjacent the junction. This is referred to as "inversion". Care must be taken to see that there is no inversion layer because this causes the energy spike to grow. We avoid inversion by the proper choice of lead concentration in the lead-cadmium-sulphide alloy layer. We have estimated that the difference between the photoelectric threshold energies of cadmium sulphide and lead sulphide is 0.3 eV. In the formula $Cd_{1-x}Pb_xS$, if x exceeds 0.5, a slight memory occurs. If x is reduced to below 0.2, there is insufficient lead present and the contact layer will revert to n-type, destroying the rectifying properties of the junction. The band concentrations in the range $0.3<\times<0.5$ work best. The band gap in layer 200 can be made small enough so the blocking potential $\phi_h$ remains nearly the same independent of the carrier type in the layer. However, if the band gap becomes too small, the large troublesome energy spike, discussed previously, will be created in layer 204.

It is well established that cadmium sulphide cannot be made p-type. We have discovered that even low concentrations of lead will enable us to dope cadmium sulphide p-type ($Cd_{0.8}Pb_{0.2}S$). The most commonly used acceptor in cadmium sulphide is copper. When copper is added to cadmium sulphide, it goes into the lattice as a substitutional impurity for cadmium. At low concentrations, the copper impurities tend to reside on the cadmium sublattice sites at random. As the copper concentration is raised, there is evidence that it tends to pair with sulphur vacancies. The sulphur vacancies are donors, so the bound pair form a compact, relatively electrically inactive dipole that is neither a net donor nor an acceptor. As the concentration of copper is increased beyond the concentration of donors, we believe the free energy of the solid is minimized if a sulphur vacancy accompanies each copper atom that is added. This mechanism accounts for the fact that cadmium sulphide never becomes p-type. In our discovery, a small amount of lead is sufficient to modify the free energy balance so that copper can substitute into the lattice without forming a complex with a sulphur vacancy.

In one example of this invention, we form an aqueous solution as follows:

| SOLUTION I | |
|---|---|
| Lead Acetate | 0.003 molar |
| Cadmium Acetate | 0.003 molar |
| Thiourea | 0.008 molar |
| Copper Acetate | 0.00012 molar |

The drum 2 forming the metal substrate 202 is rotated while being heated by radiant heat, as shown in FIG. 2, to a temperature of between 125° C. and 200° C. (±25° C.) measured at the surface of the drum. The solution is sprayed at the rate of about 300 cc. per hour and the spraying continued for about three hours until a contact layer of about one micron in thickness is formed.

The presence of copper not only permits us to dope cadmium-lead-sulphide alloy positive, but tends sharply to reduce the hole mobility. It appears that copper acts as a strong scattering center for holes. In the photoconducting layer, this has one beneficial effect and one harmful effect. The beneficial effect is that any holes that are injected at the heterojunction into the photoconducting layer are immobile and tend to stay there. This reduces fatigue, in the samples we have made which have injection in the first place, and adds some latitude to the drum manufacturing process. However, if the back contact is good enough, the copper should not be needed. Its harmful effect is that it decreases the quantum efficiency by increasing the geminite recombination rate of the photo produced electron-hole pairs.

The light-absorbing layer is formed by spray pyrolysis, from an aqueous solution, as follows:

| SOLUTION II | |
|---|---|
| Thiourea | 0.008 molar |
| Cadmium Acetate | 0.006 molar |
| Copper Acetate | 0.00012 molar |
| Zinc Acetate | 0.0006 molar |

The spray pyrolysis is continued until the light-absorbing layer has a thickness of between five and ten microns. This will take from twelve to forty hours under the same process conditions as described above.

Though we have described our invention with lead-cadmium-sulphide alloy as the contact, or junction, layer and cadmium-zinc-sulphide alloy as the light-absorbing, or photoconductive, layer, many heterojunctions may be formed without departing from the spirit of our invention. In the following tables, the topologies will be designated as follows:

| | | |
|---|---|---|
| P | for | polycrystalline |
| PB | for | polycrystalline material in a binder layer |
| A | for | amorphous |
| HA | for | hydrogenated amorphous (materials that can be doped) |
| D | for | material with sufficient disorder (e.g., a high density of stacking faults) to have its Fermi energy pinned, but shows signs of crystallinity in its X-ray patterns |
| MS | for | a molecular solid |

We have adopted a three-entry system for each material. The first position designates the composition; the second, the topology; and the third, the carrier type. Hence, our cadmium sulphide, which is disordered and slightly n-type, would be designated [CdS;D;n]. For an alloy like $Cd_{1-x}Zn_xS$, the useful concentration range will be noted in parenthesis: $[Cd_{1-x}Zn_xS(0 \leqq x < 0.1);D;n]$. If either n-type or p-type material will work, the preferred type will be listed first and the other will be added in parenthesis. Finally, the photoreceptor systems will be separated into two groups, depending on the corona charge sign. The first table designates the contact layer in respect of each example number. The second table designates the photoconductive layer in respect of each example number, together with the corona sign. The heterojunction system is formed by the contact layer and the corresponding photoconductive layer for each example number.

Heterojunction Photoreceptor Systems

| EXAMPLE Number | Contact Layer |
|---|---|
| 1. | $[Pb_{1-x}Cd_xS(0 \leqq x \leqq 0.9);P;p(n)]$ |
| 2. | $[Pb_{1-x}Cd_xS(0 \leqq x \leqq 0.65);P;p(n)]$ |
| 3. | $[Pb_{1-x}Cd_xS(0 \leqq x \leqq 0.55);P;p(n)]$ |
| 4. | $[CdTe_{1-x}S_x(0 \leqq x \leqq 0.9);P;p(n)]$ |
| 5a. | $[Ge_{1-x}Si_x(0 \leqq x < 1);P,HA;p(n)]$ |
| 5b. | $[Ge_{1-x}Si_x(0 \leqq x < 1);P,HA;n(p)]$ |
| 6. | $[Ge_{1-x}Si_x(0 \leqq x \leqq 0.5);P,HA;n(p)]$ |
| 7a. | $[Pb_{1-x}Cd_xS(0 < x < 0.6);P;n(p)]$ |
| 7b. | $[Ge_{1-x}Si_x(0 < x < 1);P;n(p)]$ |
| 8. | $[Ge;P;\left\{\begin{matrix}p\\n\end{matrix}\right\}]^*$ |
| 9. | $[Pb_{1-x}Cd_xS(0 \leqq x \leqq 0.9);P;p]$ |
| 10. | $[Pb_{1-x}Cd_xS(0 \leqq x \leqq 0.9);P;n]$ |
| 11. | $[Ge_{1-x}Si_x(0 \leqq x \leqq 1);P(A);\left\{\begin{matrix}p\\n\end{matrix}\right\}]$ |
| 12. | $[Pb_{1-x}Cd_xS(0 \leqq x \leqq 0.55);P;P\left\{\begin{matrix}p\\n\end{matrix}\right\}]$ |

*p-type when doped with boron
n-type when doped with phosphorous or arsenic

Heterojunction Photoreceptor Systems

| EXAMPLE Number | Photoconductive Layer | Corona Sign |
|---|---|---|
| 1. | $[Cd_{1-x}Zn_xS(0 < x < 0.1);D;n]$ | − |
| 2. | $[CdS_{1-x}Se_x(0 \leqq x \leqq 1);D;n]$ | − |
| 3. | $[CdS_{1-x}Te_x(0 \leqq x \leqq 1);D;n]$ | − |
| 4. | $[Cd_{1-x}Zn_xS(0 < x < 0.1);D;n]$ | − |
| 5a. | [Si;A;n(intrinsic)] | − |

-continued

| Heterojunction Photoreceptor Systems | | |
|---|---|---|
| EXAMPLE Number | Photoconductive Layer | Corona Sign |
| 5b. | [Si;A;p(intrinsic)] | + |
| 6. | [$Se_{1-x}Te_x$($0 \leqq x \leqq 0.2$);A;p] | + |
| 7a. | [$As_2S_3$;A;p] | + |
| 7b. | [$As_2S_3$;A;p] | + |
| 8. | [PVK**;MS;intrinsic] | $\left(\begin{matrix}+\\-\end{matrix}\right)$ |
| 9. | [CdS;BP;n] | -- |
| 10. | [$Pb_{1-x}Cd_xS$($0 < x < 0.9$);PB;p] | + |
| 11. | [B;A;intrinsic] | $\left(\begin{matrix}+\\-\end{matrix}\right)$ |
| 12. | [Si;A;$\left(\begin{matrix}n\\p\end{matrix}\right)$] | $\left(\begin{matrix}-\\+\end{matrix}\right)$ |

**PVK denotes poly-N—vinyl carbazole and its derivatives

EXAMPLE 1

We have indicated the solutions for both the contact layer and the photoconductive layer above. If desired, the copper, which is added to eliminate fatigue effects, may be omitted owing to the improved results we obtain with our heterojunction.

EXAMPLE 2

This heterojunction is similar to the heterojunction in EXAMPLE 1, with the contact layer being sprayed from a solution of the following concentrations: Lead acetate, 0.004 molar; cadmium acetate, 0.002 molar; thiourea, 0.008 molar; and copper acetate, 0.00012 molar. The photoconductive layer of this heterojunction is prepared from a solution having the following concentrations: Cadmium acetate, 0.006 molar; thiourea, 0.004 molar; N,N—dimethylselenuorea, 0.004 molar; and copper acetate, 0.00012 molar.

EXAMPLE 3

This heterojunction is similar to the heterojunction in EXAMPLE 2, except that tellurium is used in the photoconductive layer instead of selenium.

EXAMPLE 4

This heterojunction is similar to the heterojunction in EXAMPLE 1, except that tellurium is used in the contact layer instead of lead.

EXAMPLES 5*a*, 5*b*, and 6

These heterojunctions are formed by the glow-discharge method shown in U.S. Pat. No. 4,225,222. Germanium is used in the contact layer, and silicon is used in the photoconductive layer. A plasma discharge deposition method is used, but a chemical vapor deposition (CVD) may be employed. While we have shown polycrystalline or hydrogenated amorphous material, the polycrystalline form is more conductive than the amorphous form.

In EXAMPLE 5*a*, we will use $x=0.25$ in the contact layer. The substrate is heated to a temperature of 350° C. to 800° C. in an inert gas such as helium at 0.1 to 1 torr pressure, and when temperature equilibrium is established, a quantity of germane equal to 3.75% of the total gas and silane equivalent to 1.25% of the total gas are introduced. An r.f. glow discharge is initiated between the substrate and a counter electrode. The contact layer is grown to a thickness of approximately one micron and then the germane gas source is turned off and the inert gas left on while the drum temperature is lowered to approximately 250° C. and the excess gases are swept out. When temperature is stable, silane is reintroduced at about 5.0% level and the amorphous silicon layer will grow until a thickness of ten or more microns is attained. Deposition rates of 2 μm/hr and total thickness of photoconducting layers of 35 μm have been grown. These films exhibit excellent electrophotographic properties. The drum is cooled in flowing helium and removed when it reaches room temperature.

In EXAMPLE 5*b*, the method of preparation is identical to that of EXAMPLE 5*a*, except that the dopant gases are reversed; that is, in the contact layer, the dopant gas would be a donor, typically arsene, and it would be added at about the same levels as in the photoconductive layer of EXAMPLE 5*a*. In the photoconductive layer of EXAMPLE 5*b*, the dopant gas would be an acceptor, such as diborane.

In EXAMPLE 6, the contact layer is prepared exactly the same as that in EXAMPLE 5*b*, and the photoconductive layer is prepared by vacuum evaporation. The source material for the selenium-tellurium alloy would preferably be a dual-source system in which there was a selenium evaporation source and a tellurium evaporation source, the value of x being determined by the temperature of the two sources and their resulting relative evaporation rates. This control is difficult, but is within the state of the art.

EXAMPLE 7*a*

In this heterojunction, the contact layer is prepared in the same manner as the contact layer in EXAMPLE 2, and the photoconductive layer is prepared by vacuum evaporation of arsenic triselenide onto the surface of the contact layer.

EXAMPLE 7*b*

In this heterojunction, the contact layer is similar to the contact layer in EXAMPLE 5*a*, and the photoconductive layer is the same as that in EXAMPLE 7*a*.

EXAMPLE 8

In this heterojunction, the contact layer is prepared in the same manner as the contact layer in EXAMPLE 5*a*, with the exception that the germane quantity is 5.0% and the silicon is eliminated. If it is desired to charge with a positive charge on the surface, the dopant gas would be diborane. If a negative charge is desired on the surface, then the dopant gas would be arsene. The photoconductive layer, in this particular case, would be deposited by a spray operation or by doctor blading. The photoconductive poly-N-vinyl carbazole compound is dissolved in a solvent. This is followed by the addition of 2,4,7-trinitro-9-fluorenone to the polymer solution and a mixing of the solution for about thirty minutes. By way of example, a specific formulation of the preferred composition is as follows: 100 gms. of a 10% (wt./wt.) polyvinylcarbazole solution in tetrahydrofuran; and 16.3 gms. of 2,4,7-trinitro-9-fluoroenone added to the polymer solution. The solution then is coated onto the doped germanium contact layer, using either a doctor blade set, for example at a 0.007-inch gap or a kiss coating technique. This latter coating technique is accomplished with a continuous belt which passes into the coating solution such that a meniscus is formed between the surface of the belt and the surface of the coating solution. The thickness of the coating is determined by the concentration of the coating solution, the speed the belt is driven, and the number of passes through the solution. Preferably, the coating speed is approximately two feet per minute, and two passes are sufficient to yield the preferred coating thickness of about ten microns.

EXAMPLE 9

In this heterojunction, the contact layer is the same as the contact layer in EXAMPLE 1 and the photoconductive layer is prepared from a 1:1 by weight mixture of an organic binder and photoconductive CdS powder with a coating technique similar to EXAMPLE 8. The layers are typically 50 $\mu$m thick.

EXAMPLE 10

In this heterojunction, the contact layer is spray-deposited from a solution that is 0.003 molar in lead acetate, 0.0003 molar in cadmium chloride, and 0.012 molar in thiourea. The photoconductive layer is sprayed from a solution that is 0.006 molar in lead acetate, 0.006 molar in cadmium acetate, 0.008 molar in thiourea, and 0.00012 molar in copper acetate, and sprayed to a thickness of approximately five microns.

EXAMPLE 11

In this heterojunction, the contact layer is deposited in a manner similar to EXAMPLE 5*a* with either arsene or diborane doping for positive or negative corona, respectively. The photoconductive layer is prepared by a glow discharge process with the reactive component being diborane.

EXAMPLE 12

In this heterojunction, the contact layer is deposited as in EXAMPLE 3. The photoconductive layer is similar to EXAMPLE 5*a* when negative doping is desired and similar to EXAMPLE 5*b* when positive doping is desired. With negative doping, a negative corona is used; and with positive doping, a positive corona is used. It is understood, of course, that the contact layer is doped positively when the photoconductive layer is doped negatively and doped negatively when the photoconductive layer is doped positively. The formation of the photoconductive layer is continued until it has a thickness of between six and ten microns or more.

It will be seen that we have accomplished the objects of our invention. We have produced a multilayer photoconductive assembly with an intermediate heterojunction which is rectifying and which can be used with any photoreceptor known to the art, in which the photoreceptor has a wider band gap than the polycrystalline semiconductive contact layer forming a heterojunction with the photoconductive layer, which contact layer is in excellent conductive contact with a conductive substrate. We have provided a disordered cadmium sulphide photoconductive assembly, including a photoreceptor in which the Fermi energy is pinned slightly above mid-gap so that the material is n-type but nearly intrinsic. Our cadmium sulphide photoconductive assembly is such that the spectral response is extended toward red. We have provided a disordered cadmium sulphide photoconductive assembly having mobility and trap edges in the conduction and valence bands. We have provided a disordered cadmium sulphide photoconductive assembly in which the carrier concentration is nearly independent of doping levels. Our contact layer is preferably interposed between an n-type photoreceptor and a metal substrate, which contact layer comprises a cadmium-lead-sulphide alloy doped p-type. Our multilayer photoconductive assembly with an intermediate heterojunction allows charge to flow from the photoreceptor to ground, but blocks charge from being injected into the photoconductor from the back contact. This increases the charge density which can be placed on the photoreceptor while decreasing fatigue, memory, and residual voltage. Since our heterojunction is actually doubly rectifying, charges from the photoreceptor can easily pass through the heterojunction to ground, but no charges, whether they be electrons or holes, can pass from the conductive substrate to the photoreceptor. Accordingly, the contact layer may be n-type, while the photoconductive layer is nearly intrinsic and is also either n-type or p-type.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A photoconductive assembly including in combination a conductive substrate, a first semiconductive layer of a type of one carrier polarity, said first layer having a band gap, said first layer being in low-resistance contact with said conductive substrate, and a light-absorbing second semiconductive layer of a type of opposite carrier polarity to the carrier polarity of said first layer, said second layer having a band gap wider than the band gap of said first layer, said first and second layers forming a rectifying heterojunction therebetween.

2. A photoconductive assembly including in combination a conductive substrate, a first semiconductive layer comprising lead-cadmium-sulphide alloy, said first layer having a band gap and being in low-resistance contact with said conductive substrate, and a light-absorbing second layer comprising cadmium-zinc-sulphide alloy, said second layer having a band gap wider than the band gap of said first layer, said first and second layers forming a rectifying heterojunction therebetween.

3. A photoconductive assembly including in combination a conductive substrate, a first semiconductive layer comprising a cadmium-lead-sulphide alloy having the formula $Cd_{1-x}Pb_xS$ where x lies between 0.5 and 0.3, said first layer having a band gap and being in low-resistance contact with said conductive substrate, and a lightabsorbing second semiconductive layer having an n-type carrier polarity and a band gap wider than the band gap of said first layer, said first and second layers forming a rectifying heterojunction therebetween.

4. A photoconductive assembly including in combination a conductive substrate, a first semiconductive layer of a type of one carrier polarity having a thickness in the order of one micron or less, said first layer having a band gap, said first layer being in low-resistance contact with said conductive substrate, and a light-absorbing second semiconductive layer having a thickness of five microns or more of a type of opposite carrier polarity to the carrier polarity of said first layer, said second layer having a band gap wider than the band gap of said first layer, said first and second layers forming a rectifying heterojunction therebetween.

5. A photoconductive assembly including in combination a conductive substrate, a first semiconductive layer of a type of one carrier polarity and having a thickness in the order of one micron or less, said first layer having a band gap, said first layer being in lowresistance contact with said conductive substrate, said low resistance being in the order of $1.7\times10^6$ ohms per square centimeter or less, and a light-absorbing second semiconductive layer of a type of opposite carrier polarity to the carrier polarity of said first layer, said second layer having a band gap wider than the band gap of said first layer, said first and second layers forming a rectifying heterojunction therebetween.

6. A photoconductive assembly including in combination a conductive substrate, a first semiconductive layer formed of cadmium sulphide having the formula $Cd_{1-x}Pb_xS$ in which x is 0.2 or more, said first semiconductive layer being doped to a positive carrier polarity and having a band gap, said first layer being in lowresistance contact with said conductive substrate, and a light-absorbing second semiconductive layer of negative carrier polarity, said second layer having a band gap wider than the band gap of said first layer, said first and second layers forming a heterojunction therebetween.

7. A photoconductive assembly including a combination a conductive substrate, a first semiconductive layer comprising cadmium-lead-sulphide alloy having a formula $Cd_{1-x}Pb_xS$ where x lies between 0.5 and 0.3, said first layer being doped with copper to have a positive carrier polarity, said first layer having a band gap and being in low-resistance contact with said conductive substrate, said low resistance being in the order of $1.7\times10^6$ ohms per square centimeter or less, and a light-absorbing second semiconductive layer having an in-type carrier polarity and a band gap wider than the band gap of said first layer, said first and second layers forming a rectifying heterojunction therebetween.

8. A photoconductive assembly including in combination a conductive substrate, a first semiconductive layer comprising a germanium-silicon alloy having the general formula $Ge_{1-x}Si_x$ in which x is 0.25 or less, said first layer being doped to one carrier polarity, said first layer having a band gap and being in low-resistance contact with said conductive substrate, and a light-absorbing second semiconductive layer formed of amorphous silicon and doped to be of a type of opposite carrier polarity to the carrier polarity of said first layer, said second layer having a band gap wider than the band gap of said first layer, said first and second layers forming a rectifying heterojunction therebetween.

9. A photoconductive assembly including in combination a conductive substrate, a first semiconductive layer comprising a cadmium-lead-sulphide alloy doped n-type with chlorine, said first layer having a band gap and being in low-resistance contact with said conductive substrate, and a light-absorbing second semiconductive layer comprising a lead-cadmium-sulphide alloy doped positive with copper, said second layer having a thickness in the order of five times or more the thickness of said first layer, said second layer having a band gap wider than the band gap of said first layer, said first and second layers forming a rectifying heterojunction therebetween.

10. A photoconductive assembly including in combination a conductive substrate, a first semiconductive layer comprising a lead-cadmium-sulphide alloy, said first layer being in low resistance contact with said conductive substrate, and a light-absorbing second semiconductive layer comprising a cadmium sulphide-zinc sulphide alloy, said first and second layers forming a rectifying heterojunction therebetween.

11. A photoconductive assembly including in combination a conductive substrate, a first semiconductive layer comprising a cadmium sulphide-lead sulphide alloy doped negative, said first layer being in low-resistance contact with said conductive substrate, and a light-absorbing second semiconductive layer comprising a cadmium sulphide-zinc sulphide alloy doped with copper, said first and second layers forming a rectifying heterojunction therebetween.

12. A photoconductive assembly including in combination a conductive substrate, a first semiconductive layer comprising a lead sulphide-cadmium sulphide alloy forming a low-resistance contact with said conductive substrate, and a light-absorbing second semiconductive layer formed on said first layer, said second layer comprising a major amount of cadmium sulphide and a minor amount of zinc sulphide, said first and second layers forming a rectifying heterojunction therebetween.

13. A photoconductive assembly including in combination a conductive substrate, first and second semiconductive layers in contact with each other, said first semiconductive layer being of a type of carrier polarity opposite to that of the highest mobility species of said second semiconductive layer, said first layer having a band gap, said first layer being in low-resistance contact with said conductive substrate, said second semiconductive layer being nearly intrinsic and having a band gap wider than the band gap of said first layer, said first and second layers forming a rectifying heterojunction therebetween.

14. A photoconductive assembly adapted to be corona-charged with a charge of a certain polarity sign including in combination a conductive substrate, a first semiconductive layer of a type of carrier polarity opposite to that of the sign of said corona charge, said first layer having a band gap, said first layer being in low-resistance contact with said conductive substrate, and a lightabsorbing nearly intrinsic second semiconductive layer, said second layer having a band gap wider than the band gap of said first layer, said first and second layers forming a rectifying heterojunction therebetween.

* * * * *

UNITED STATES PATENT AND TRADEMARK OFFICE

CERTIFICATE OF CORRECTION

PATENT NO. : 4,343,881

DATED : August 10, 1982

INVENTOR(S) : Arden Sher and John B. Mooney

It is certified that error appears in the above-identified patent and that said Letters Patent are hereby corrected as shown below:

Column 19, line 42, "in-" should read -- n- --.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*